US006882095B2

(12) United States Patent
Avnery

(10) Patent No.: US 6,882,095 B2
(45) Date of Patent: Apr. 19, 2005

(54) ELECTRON ACCELERATOR HAVING A WIDE ELECTRON BEAM

(75) Inventor: Tzvi Avnery, Winchester, MA (US)

(73) Assignee: Advanced Electron Beams, Inc., Wilmington, MA (US)

( * ) Notice: Subject to any disclaimer, the term of this patent is extended or adjusted under 35 U.S.C. 154(b) by 134 days.

(21) Appl. No.: 10/364,295

(22) Filed: Feb. 10, 2003

(65) Prior Publication Data

US 2003/0218414 A1 Nov. 27, 2003

Related U.S. Application Data

(62) Division of application No. 09/209,024, filed on Dec. 1, 1998, now Pat. No. 6,545,398.

(51) Int. Cl.[7] ..... H01J 5/18

(52) U.S. Cl. ..... 313/361.1; 315/111.81; 315/360.1

(58) Field of Search ..... 315/111.21, 111.31, 315/111.61, 111.81; 313/360.1, 359, 361.1

(56) References Cited

U.S. PATENT DOCUMENTS

| | | | |
|---|---|---|---|
| 3,433,947 | A | 3/1969 | Emanuelson et al. |
| 3,440,466 | A | 4/1969 | Colvin et al. |
| 3,610,993 | A | 10/1971 | Randels |
| 3,617,740 | A | 11/1971 | Skillicorn |
| 3,749,967 | A | 7/1973 | Douglas-Hamilton et al. |
| 3,863,163 | A | 1/1975 | Farrell et al. |
| 3,956,712 | A | 5/1976 | Hant |
| 4,020,354 | A | 4/1977 | Fauss et al. |
| 4,048,534 | A | 9/1977 | Brewer et al. |
| 4,061,944 | A | 12/1977 | Gay |
| 4,079,328 | A | 3/1978 | Cleland et al. |
| 4,143,272 | A | 3/1979 | Frank |
| 4,246,297 | A | 1/1981 | Nablo et al. |
| 4,328,443 | A | 5/1982 | Zappa |
| 4,446,374 | A | 5/1984 | Ivanov et al. |
| 4,468,282 | A | 8/1984 | Neukermans |
| 4,499,405 | A | 2/1985 | Loda |
| 4,584,468 | A | 4/1986 | van de Wiel |
| 4,646,338 | A | 2/1987 | Skillicorn |
| 4,703,234 | A | 10/1987 | Kato |
| 4,705,988 | A | 11/1987 | Tran et al. |
| 4,746,909 | A | 5/1988 | Israel et al. |
| 4,910,435 | A | 3/1990 | Wakalopulos |
| 4,957,835 | A | 9/1990 | Aden |
| 5,003,178 | A | 3/1991 | Livesay |
| 5,004,952 | A | 4/1991 | Ikes et al. |
| 5,093,602 | A | 3/1992 | Kelly |
| 5,126,633 | A | 6/1992 | Avnery et al. |
| 5,236,159 | A | 8/1993 | Avnery et al. |
| 5,254,911 | A | 10/1993 | Avnery et al. |
| 5,378,898 | A | 1/1995 | Schonberg et al. |
| 5,382,802 | A | 1/1995 | Anabuki et al. |
| 5,414,267 | A | 5/1995 | Wakalopulos |
| 5,483,074 | A | 1/1996 | True |
| 5,561,298 | A | 10/1996 | Cirlin et al. |
| 5,561,342 | A | 10/1996 | Roeder et al. |
| 5,621,270 | A | 4/1997 | Allen |
| 5,631,471 | A | 5/1997 | Anderl et al. |
| 5,962,995 | A | 10/1999 | Avnery |

FOREIGN PATENT DOCUMENTS

| | | | |
|---|---|---|---|
| WO | WO 98/29895 | 7/1998 | ..... H01J/33/00 |

*Primary Examiner*—Joseph Williams
(74) *Attorney, Agent, or Firm*—Hamilton, Brook, Smith & Reynolds, P.C.

(57) ABSTRACT

An electron accelerator for generating an electron beam includes a vacuum chamber having an outer perimeter and an electron beam exit window. The exit window has a central region and a first end region. An electron generator is positioned within the vacuum chamber for generating electrons. The electron generator and the vacuum chamber are shaped and positioned relative to each other to accelerate the electrons in an electron beam out through the exit window. The electrons pass through the central region of the exit window substantially perpendicular to the exit window and through the first end region of the exit window angled outwardly relative to the exit window. At least a portion of the outwardly angled electrons are directed beyond the perimeter of the electron accelerator.

10 Claims, 15 Drawing Sheets

ELECTRON ACCELERATOR HAVING A WIDE ELECTRON BEAM

RELATED APPLICATION

This application is a divisional of U.S. application Ser. No. 09/209,024, filed Dec. 10, 1998 now U.S. Pat. No. 6,545,398. The entire teachings of the above application are incorporated herein by reference.

BACKGROUND

During manufacturing, paper goods often have some form of coating applied thereon such as adhesives or inks which usually require some type of curing process. Examples of such coated paper goods include magazines, labels, stickers, prints, etc. The coatings are typically applied to the paper when the paper is in the form of a continuously moving web of paper. Current manufacturing methods of curing coatings on a moving web include subjecting the coatings to heat, UV light or electron beams.

When curing coatings on a moving web with electron beams, an electron beam system is usually positioned over the moving web. If the web has a large width, for example 50 inches or more, an electron beam system consisting of multiple electron beam devices is sometimes used to irradiate the full width of the web. The electron beam devices in such a system are staggered relative to each other resulting in a staggered pattern of electron beams that are separated from each other and provide full electron beam coverage across the width of the web only when the web is moving. The staggered arrangement is employed because, if multiple electron beam devices were positioned side by side, the electron beam coverage on a moving web would be interrupted with gaps between electron beams. A staggered arrangement is depicted in application Ser. No. 08/778,037, filed Jan. 2, 1997, the teachings of which are incorporated by reference herein in their entirety.

SUMMARY OF THE INVENTION

A drawback of an electron beam system having staggered electron beam devices is that such a system can require a relatively large amount of space, particularly in situations where multiple sets of staggered electron beam devices are positioned in series along the direction of the moving web for curing coatings on webs moving at extremely high speeds (up to 3000 ft./min.). This can be a problem in space constrained situations.

One aspect of the present invention is directed towards an electron beam accelerator device which can be mounted adjacent to one or more other electron beam accelerator devices along a common axis to provide overlapping continuous electron beam coverage along the axis. This allows wide electron beam coverage while remaining relatively compact in comparison to previous methods. The present invention provides an electron accelerator including a vacuum chamber having an outer perimeter and an electron beam exit window. The exit window has a central region and a first end region. An electron generator is positioned within the vacuum chamber for generating electrons. The electron generator and the vacuum chamber are shaped and positioned relative to each other to accelerate electrons in an electron beam out through the exit window. The electrons pass through the central region of the exit window substantially perpendicular to the exit window and through the first end region of the exit window angled outwardly relative to the exit window. At least a portion of outwardly angled electrons are directed beyond the outer perimeter.

In preferred embodiments, the exit window has a second end region opposite to the first end region. Electrons passing through the exit window at the second end region are angled outwardly. At least a portion of the electrons angled outwardly through the second end region are directed beyond the outer perimeter. The electron generator is positioned within the vacuum chamber relative to the exit window in a manner to form flat electrical field lines near the central region of the exit window and curved electrical field lines near the first and second end regions of the exit window. The flat electrical field lines direct electrons through the central region in a perpendicular relation to the exit window and the curved electrical field lines direct electrons through the first and second end regions at outward angles. The exit window has window openings for allowing passage of electrons therethrough. The window openings near the first and second end regions of the exit window are angled outwardly for facilitating the passage of outwardly angled electrons. In this manner, the present invention electron accelerator is able to generate an electron beam that is wider than the width of the accelerator.

Preferably the electron generator includes at least one filament for generating electrons. A filament housing surrounds the at least one filament and has a series of housing openings formed in the filament housing between the at least one filament and the exit window for allowing the electrons to accelerate from the at least one filament out through the exit window. The housing openings are preferably configured to allow higher concentrations of electrons to exit regions of the filament housing associated with the first and second end regions of the exit window than through the central region. In one preferred embodiment, the housing openings include central and outer housing openings. The outer housing openings provide greater open regions than the central housing openings. In another preferred embodiment, the housing openings include elongate slots.

One embodiment of the invention provides an electron accelerator system including a first electron accelerator capable of generating a first electron beam having a portion extending laterally beyond the first electron accelerator. A second electron accelerator is positioned adjacent to the first electron accelerator along a common axis. The second electron accelerator is capable of generating a second electron beam having a portion extending laterally beyond the second electron accelerator to overlap along said axis with the portion of the first electron beam extending laterally beyond the first electron accelerator.

In preferred embodiments, the first and second electron accelerators are each constructed in the manner previously described above.

In one embodiment, an electron accelerator system is adapted for a sheet-fed machine including a rotating transfer cylinder for receiving a sheet of material. The transfer cylinder has a holding device for holding the sheet against the transfer cylinder. An electron accelerator is spaced apart from the transfer cylinder for irradiating the sheet with an electron beam.

In preferred embodiments, a pair of inwardly skewed rollers contact and hold the sheet against the rotating transfer cylinder. The electron accelerator and at least a portion of the transfer cylinder are enclosed within an enclosure. An inert gas source is coupled to the enclosure to fill the enclosure with inert gas. An ultrasonic device can be mounted to the enclosure for vibrating gases against the sheet to tightly force the sheet against the transfer cylinder. In addition, a blower can be mounted to the enclosure for forcing the sheet against the transfer cylinder.

In another embodiment, a system is adapted for irradiating a continuously moving web. The web travels from a pair of upstream pinch rollers to a downstream roller. The system includes an electron accelerator system for irradiating the web with an electron beam. An enclosure substantially encloses the web between the up stream pinch rollers and the downstream roller. The enclosure has an up st ream shield positioned close to the upstream pinch rollers and a downstream shield positioned close the downstream roller. An inert gas source is coupled to the enclosure to fill the enclosure with inert gas. The upstream and downstream shields are positioned sufficiently close to the upstream pinch rollers and downstream roller to prevent substantial inert gas from escaping the enclosure. The upstream pinch rollers block air from the web as the web enters the enclosure such that substantial intrusion of air into the enclosure is prevented.

In preferred embodiments, the electron accelerator system includes at least one electron beam device positioned within a module enclosure to form an electron beam module which is mounted to the web enclosure. In high speed applications, the electron accelerator system may include more than one electron beam module mounted in series along the web enclosure.

In still another embodiment, a system is adapted for irradiating a continuously moving web. An electron accelerator irradiates the web with an electron beam. An enclosure encloses the electron accelerator and a portion of the web. A series of ultrasonic members are positioned within the enclosure. The web travels over the ultrasonic members and is redirected within the enclosure. The enclosure has an entrance and an exit for the web which are out of direct alignment with the electron accelerator to prevent the escape of radiation from the enclosure.

Another embodiment of the invention provides an electron gun including a filament for generating electrons. The filament is surrounded by a housing. The housing has at least one elongate slot extending parallel to the filament along a substantial length of the filament. Preferably the electron gun includes two filaments with the housing having a total of six slots, three slots being associated with each filament. The width of each slot preferably becomes greater at the ends.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 5:
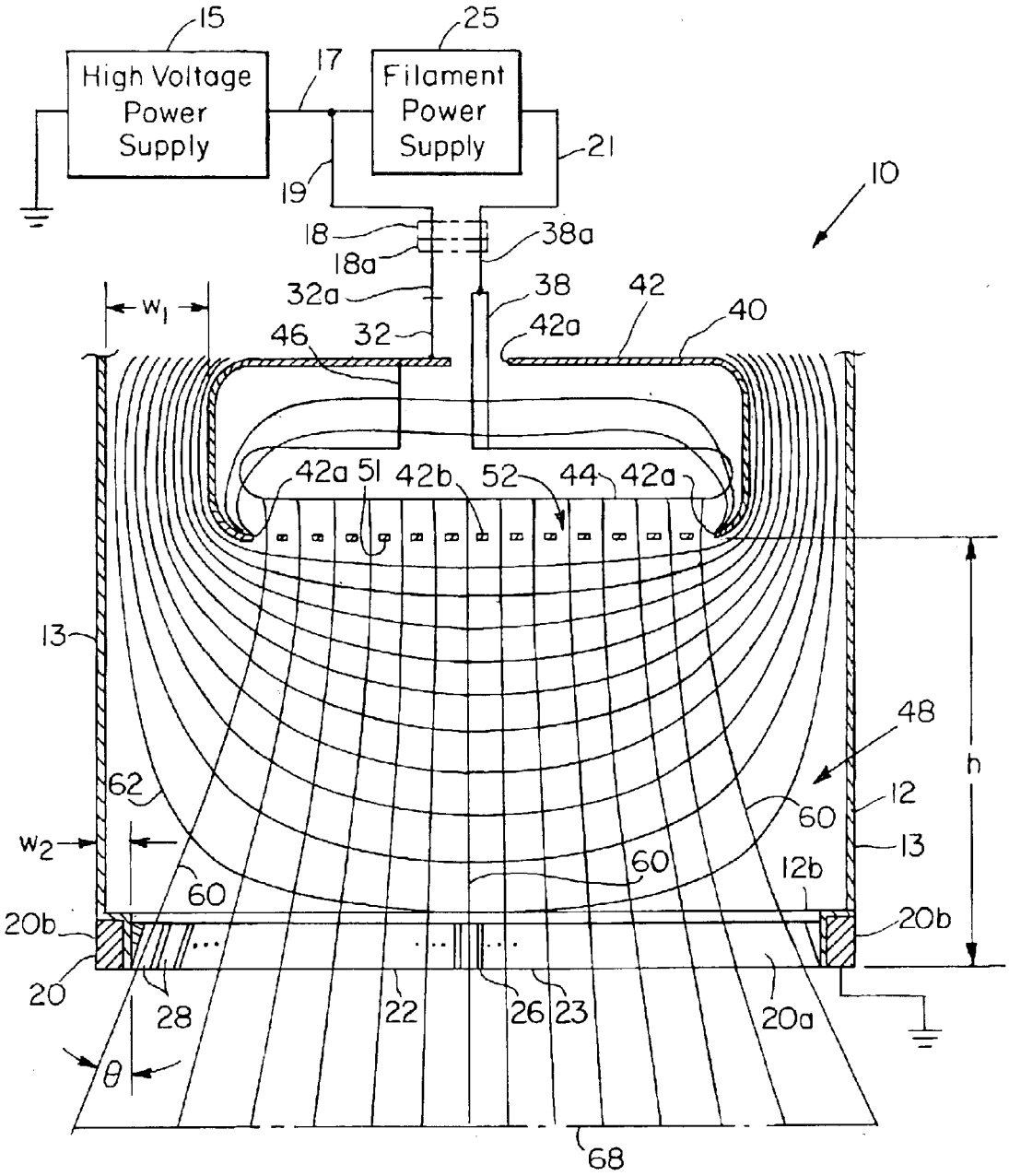
FIG. 5 is a side sectional view of the lower portion of the present invention electron beam device depicting electrical field lines and the paths of accelerated electrons.

Referring to FIGS. 1–5, the present invention provides an electron beam accelerator device 10 which produces an electron beam 68 (FIG. 5) having portions that extend laterally beyond the sidewalls 13 of electron beam device 10. In other words, electron beam 68 is wider than electron beam device 10. Electron beam device 10 includes a hermetically sealed generally cylindrical vacuum chamber 12 having a permanent vacuum therein and a high voltage connector 14 coupled to the vacuum chamber 12. An electron gun 40 (FIGS. 3, 4, and 5) is positioned within the interior 48 of vacuum chamber 12 and includes a generally disc shaped or circular filament housing 42 containing a pair of filaments 44 for generating electrons 60 (FIG. 5). The electrons 60 generated by filaments 44 are accelerated from electron gun 40 out through an exit window 20 extending from the bottom 12*b* of vacuum chamber 12 in an electron beam 68.

Exit window 20 includes a rectangular support plate 20*a* having a series of vertical or perpendicular holes 26 (FIG. 3) therethrough in central regions 23 and outwardly angled holes 28 therethrough in regions near the ends 20*b*. The outwardly angled holes 28 can include a section of intermediate holes adjacent to holes 26 that gradually become more angled. A window membrane 22, preferably made of titanium foil, is joined to the edges of the support plate 20*a* covering holes 26/28 and vacuum sealing exit window 20. The preferred method of joining is by bonding under heat and pressure, but alternatively, could be brazing or welding.

High voltage connector 14 couples electron beam device 10 to a high voltage power supply 15 and a filament power supply 25 (FIG. 5) via cable connector 18*a* and cable 18. High voltage connector 14 includes a cup shaped conductor 32*a* (FIG. 3) which is electrically connected to cable connector 18*a* and embedded within a matrix of insulating epoxy 30. Conductor 32*a* electrically connects with a tubular conductor 32 protruding from vacuum chamber 12 through annular ceramic insulator 36. Tubular conductor 32 extends from the filament housing 42 of electron gun 40. A jumper 38*a* (FIG. 3) electrically connects cable connector 18*a* to a conductor 38 protruding from vacuum chamber 12 through annular ceramic insulator 50 and tubular conductor 32. Conductor 38 extends from filaments 44 through opening 42*a* of filament housing 42 and through the interior of conductor 32. Insulators 36 and 50 are sealed to conductors 32 and 38, respectively, and insulator 36 is also sealed to the neck 16 of vacuum chamber 12 to maintain the vacuum therein.

Referring to FIG. 5, conductors 32, 32*a*, cable connector 18*a*, line 19 and line 17 electrically connect filament housing 42 to high voltage power supply 15. A conductor 46 (FIG. 4) extending within the interior of filament housing 42 is electrically connected to filaments 44 at one end to electrically connect the filaments 44 to filament power supply 25 via conductors 32, 32*a*, cable connector 18*a*, line 19 and line 17. The filaments 44 are electrically connected at the other end to filament power supply 25 via conductor 38, jumper 38*a*, cable connector 18*a* and line 21. The exit window 20 is electrically grounded to impose a high voltage potential between filament housing 42 and exit window 20.

In use, filaments 44 are heated to about 3400° F. to 4200° F. with electrical power from filament power supply 25 (AC or DC) which causes free electrons 60 to form on filaments 44. The high voltage potential between the filament housing 42 and exit window 20 imposed by high voltage power supply 15 causes the free electrons 60 on filaments 44 to accelerate from the filaments 44, through the series of openings 52 in filament housing 42 and through the exit window 20 in an electron beam 68. A high voltage penetrating field pulls the electrons 60 from the filaments 44. Electron gun 40 is positioned a sufficient distance $W_1$ away from the side walls 13 of vacuum chamber 12 for a proper high voltage gap. The bottom 51 of filament housing 42 is positioned a distance h away from exit window 20 such that the electrical field lines 62 close to the inner surface of exit window 20 are curved near the ends 20*b* of exit window 20, but are flat near the central portions 23 of exit window 20. A distance h that is too short produces electrical field lines 62 which are flat along most of the exit window 20 and have only a very small curved region near side walls 13. A preferred distance h results in electrical field optics in which electrons 60 generated by filaments 44 are accelerated through exit window 20 in a vertical or perpendicular relation to exit window 20 in central portions 23 of the exit window 20 where the electrical field lines 62 are flat and at outward angles near the ends 20*b* of the exit window 20 where the electrical field lines 62 are curved. The reason for this is that electrons tend to travel in a perpendicular relationship relative to electrical field lines. At the preferred distance h, the angle θ at which the electrons 60 travel through exit window 20 near ends 20*b* is preferably between about 15° to 30° with about 20° being the most preferable for the embodiment shown in FIG. 5 to direct electrons 60 laterally beyond the side walls 13 of vacuum chamber 12.

The vertical holes 26 through support plate 20*a* are located in the central regions 23 of exit window 20 for allowing passage of electrons 60 traveling perpendicularly relative to exit window 20. The outwardly angled holes 28 are located near the ends 20*b* of exit window 20 and are preferably made at an angle θ through support plate 20*a* for facilitating the passage of electrons 60 traveling at about the same outward angle θ relative to exit window 20.

The outwardly angled holes 28 through support plate 20*a* at the ends 20*b* of exit window 20 are positioned a distance $W_2$ close enough to the outer surface or perimeter of side walls 13 of vacuum chamber 12 such that some electrons 60 of electron beam 68 traveling through holes 28 at the angle θ near the ends 20*b* of exit window 20 extend laterally beyond the side walls 13 of vacuum chamber 12. Some electrons 60 are also directed beyond sidewalls 13 by scattering caused by window membrane 22 and the air outside exit window 20 as the electrons 60 pass therethrough. This results in an electron beam 68 which is wider than the width of vacuum chamber 12. Varying the distance of the material to be radiated relative to the exit window 20 can also vary the distance that the electrons 60 extend beyond the width of vacuum chamber 12.

Since some electrons 60 passing through exit window 20 near the ends 20*b* of exit window 20 are spread outwardly beyond ends 20*b*, the electrons 60 at the ends of the electron beam 68 are spread out over a larger area than electrons 60 in central portions of electron beam 68. In order to obtain an electron beam 68 of consistent intensity, greater numbers of electrons 60 are preferably emitted near the ends 42*a* of filament housing 42 than in the middle 42*b* of filament housing 42.

Figure 6:
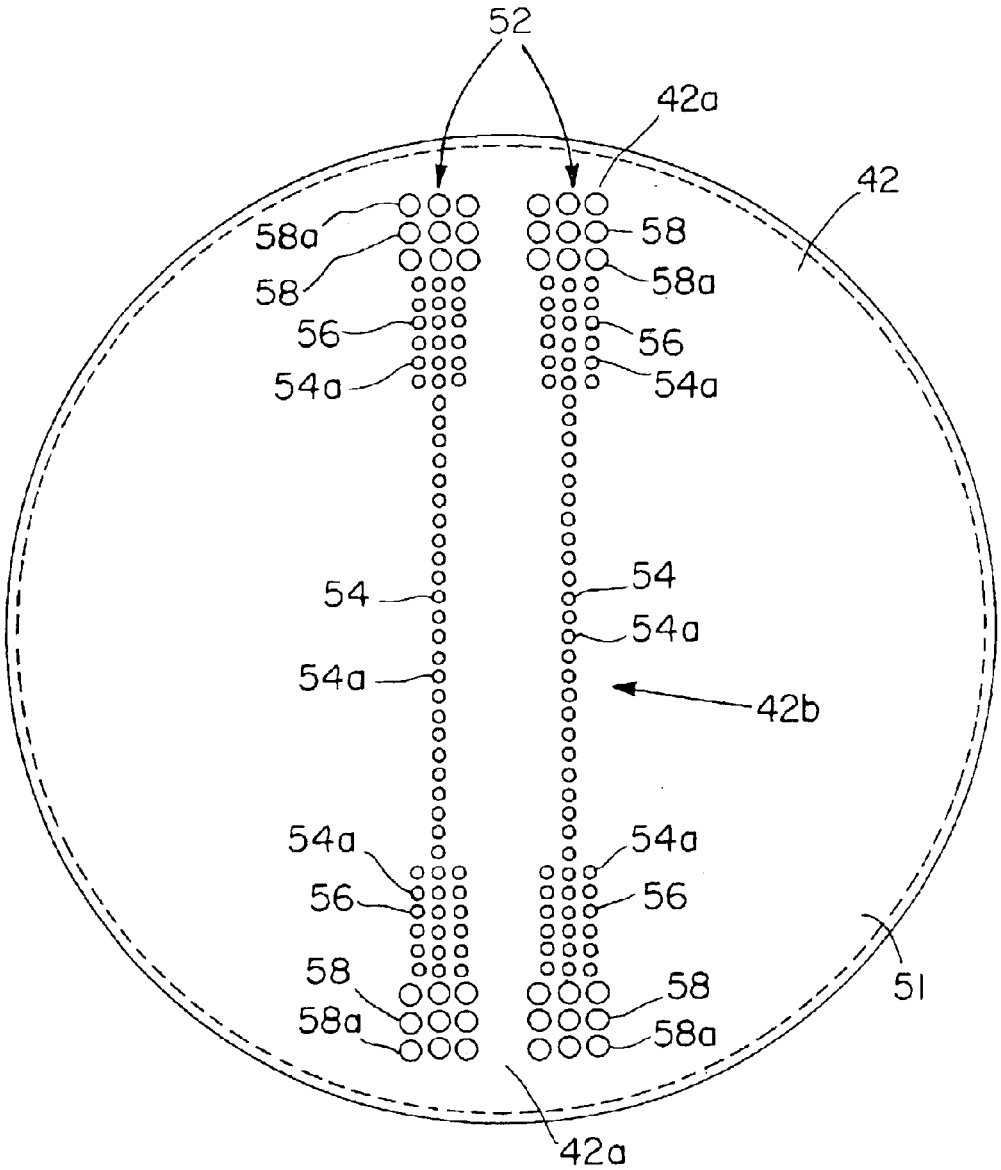
FIG. 6 is a bottom view of the filament housing of the present invention electron beam device.

FIG. 6 depicts the preferred filament housing 42 for emitting greater numbers of electrons 60 near the ends 42*a*. The bottom 51 of filament housing 42 includes a series of openings 52 below each filament 44. Each series of openings 52 has a middle portion 54 consisting of a row of small openings 54*a*, two intermediate portions 56 consisting of 3 short rows of small openings 54*a* and two end portions 58 consisting of 3 short rows of large openings 58*a*. This results in more open regions at the ends of each series of openings 52 which allows a greater concentration of electrons 60 to pass through the intermediate 56 and end 58 portions of each series of openings 52 than in the middle portion 54. Consequently, higher concentrations of electrons 60 are directed towards angled holes 28 at the ends 20*b* of exit window 20 than through vertical holes 26 in central portions 23 of exit window 20 so that as the electrons 60 near the ends 20*b* of exit window 20 are spread outwardly, the intensity across the central region of the electron beam 68 is kept relatively uniform between about 5% to 10%.

Figure 7A:
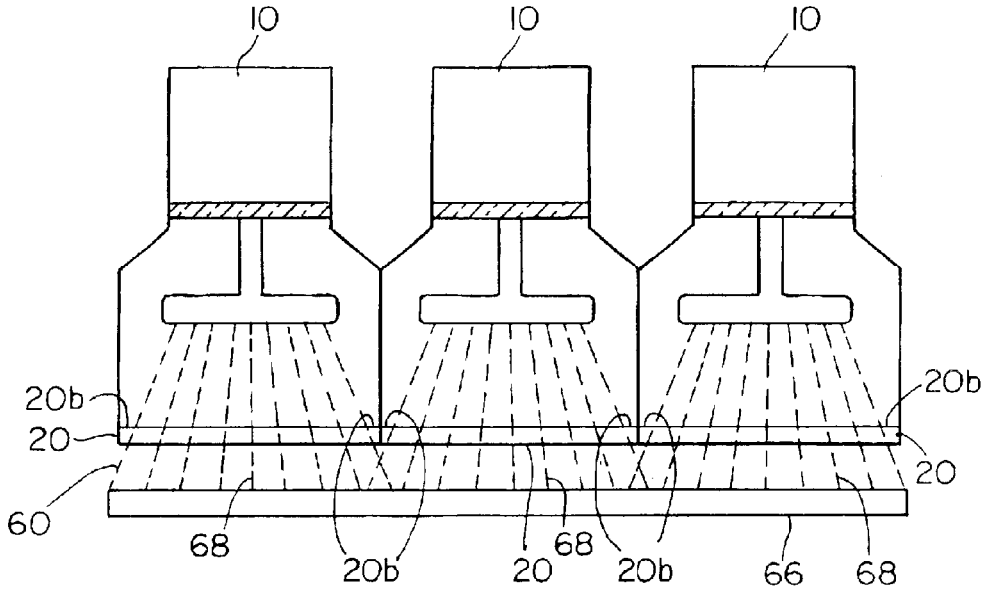
FIG. 7A is a side schematic view of three electron beam devices of the present invention joined side-by-side to provide continuous electron beam coverage.
Figure 7B:
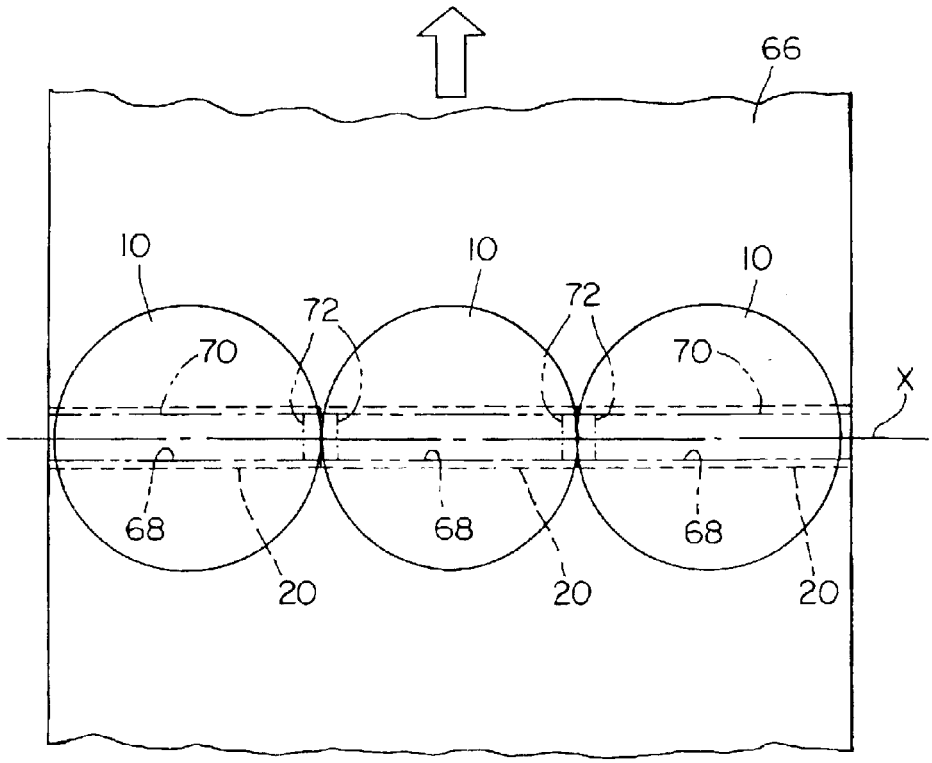
FIG. 7B is a top schematic view of the three electron beam devices of FIG. 7A.

Referring to FIGS. 7A and 7B, the ability of the electron beam device 10 to generate an electron beam 68 that is wider or greater than the width of vacuum chamber 12 allows multiple electron beam devices 10 to be mounted side-by-side-in-line along a common lateral axis X with exit windows 20 positioned end to end (ends 20*b* being adjacent to each other) to provide overlapping uninterrupted continuous wide electron beam coverage along a common axis X. In this manner, materials 66 that are wider than an individual electron beam devices 10 can be radiated to cure adhesives, inks or other coatings thereon. The advantage of this configuration is that it is more comp act than mounting multiple electron beam devices in a staggered relationship.

Figure 8:
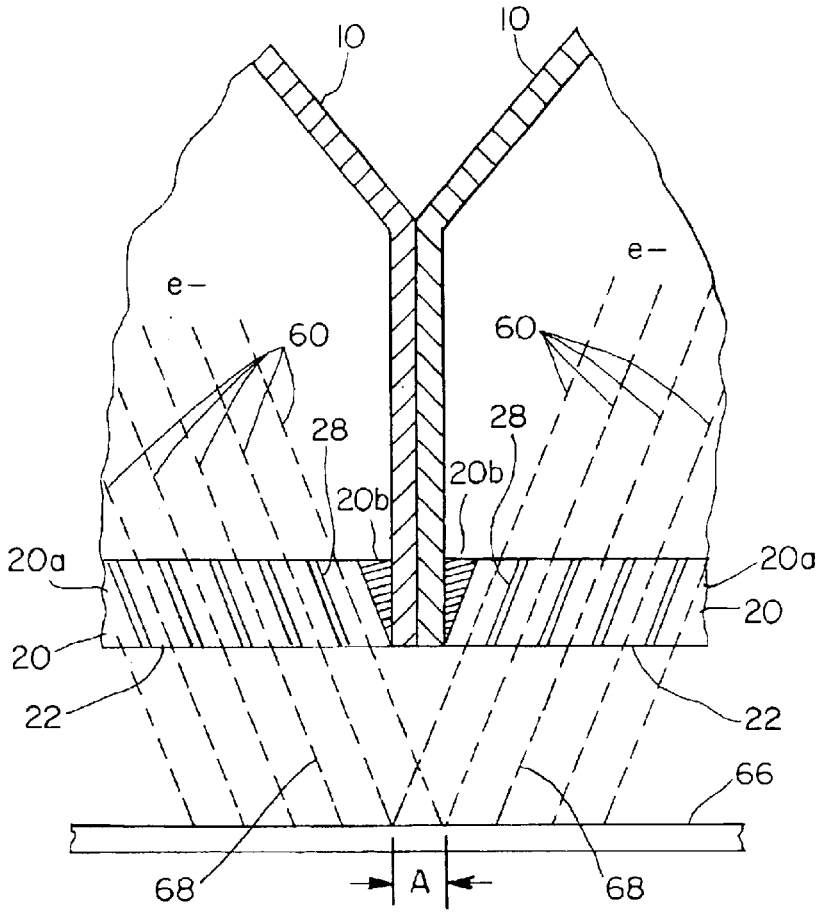
FIG. 8 is an enlarged sectional view of portions of two adjoining present invention electron beam devices with the electron beams overlapping.
Figure 9:
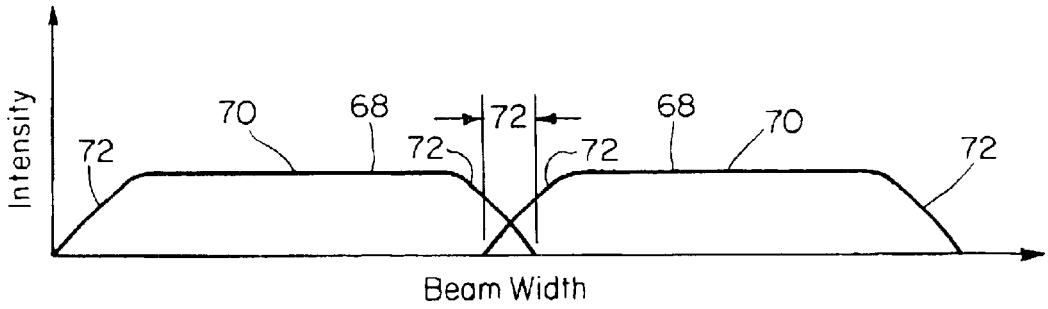
FIG. 9 is a graph depicting the intensity profiles of two overlapping electron beams of two adjoining electron beam devices.

FIG. 8 depicts an enlarged view of the electron beams 68 of two adjoining electron beam devices 10 overlapping at an interface A to provide uninterrupted continuous electron beam coverage between the two devices 10. As can be seen in FIG. 9, the intensity of two adjoining electron beams 68 is uniform in the center 70 of each beam 68 and sharply declines on the edges 72 at interface A. By overlapping the edges 72 of the electron beams 68, the sum of the intensities of the two overlapping edges 72 at interface A approximately equals the intensity of beams 68 at the center 70 of beams 68. As a result, there is a substantially consistent intensity level across the transition from one electron beam 68 to the next.

A more detailed description of electron beam device 10 now follows. Referring to FIGS. 1–4, vacuum chamber 12 includes a conical or angled portion 12*a* which joins to a narrowed neck 16. A mounting flange 16*a* extends outwardly from neck 16. High voltage connector 14 includes an outer shell 14*b* having an outwardly extending mounting flange 14*a* which couples to mounting flange 16*a* for coupling high voltage connector 14 to vacuum chamber 12. High voltage connector 14 is preferably coupled to vacuum chamber 12 with screws or clamps, thereby allowing vacuum chamber 12 or high voltage connector 14 to be easily replaced. An annular silicone rubber disc 34 is preferably positioned between matrix 30 and insulator 36. Disc 34 compresses during assembly and prevents the existence of air gaps between matrix 30 and insulator 36 which could cause electrical arcing. The narrowed neck 16 allows high voltage connector 14 to have a smaller diameter than vacuum chamber 12, thereby reducing the size of electron beam device 10. In the preferred embodiment, the matrix of insulating epoxy 30 extends into neck 16 when connector 14 is coupled to vacuum chamber 12 so that the annular silicone rubber disc 34 is sandwiched within neck 16 between the epoxy matrix 30 and annular ceramic insulating disc 36. Conductor 38 is preferably electrically connected to connector 18*a* by jumper 38*a* but, alternatively, can be connected by a quick connecting plug. Typically, vacuum chamber 12 and connector 14 have an outer shell 14*b* of stainless steel between about ¼ to ⅜ inches thick but, alternatively, can be made of KOVAR®. The diameter of vacuum chamber 12 in one preferred embodiment is about 10 inches but, alternatively, can be other suitable diameters. Furthermore, vacuum chamber 12 can have other suitable cross sectional shapes such as a square, rectangular or oval cross section.

Figure 1:
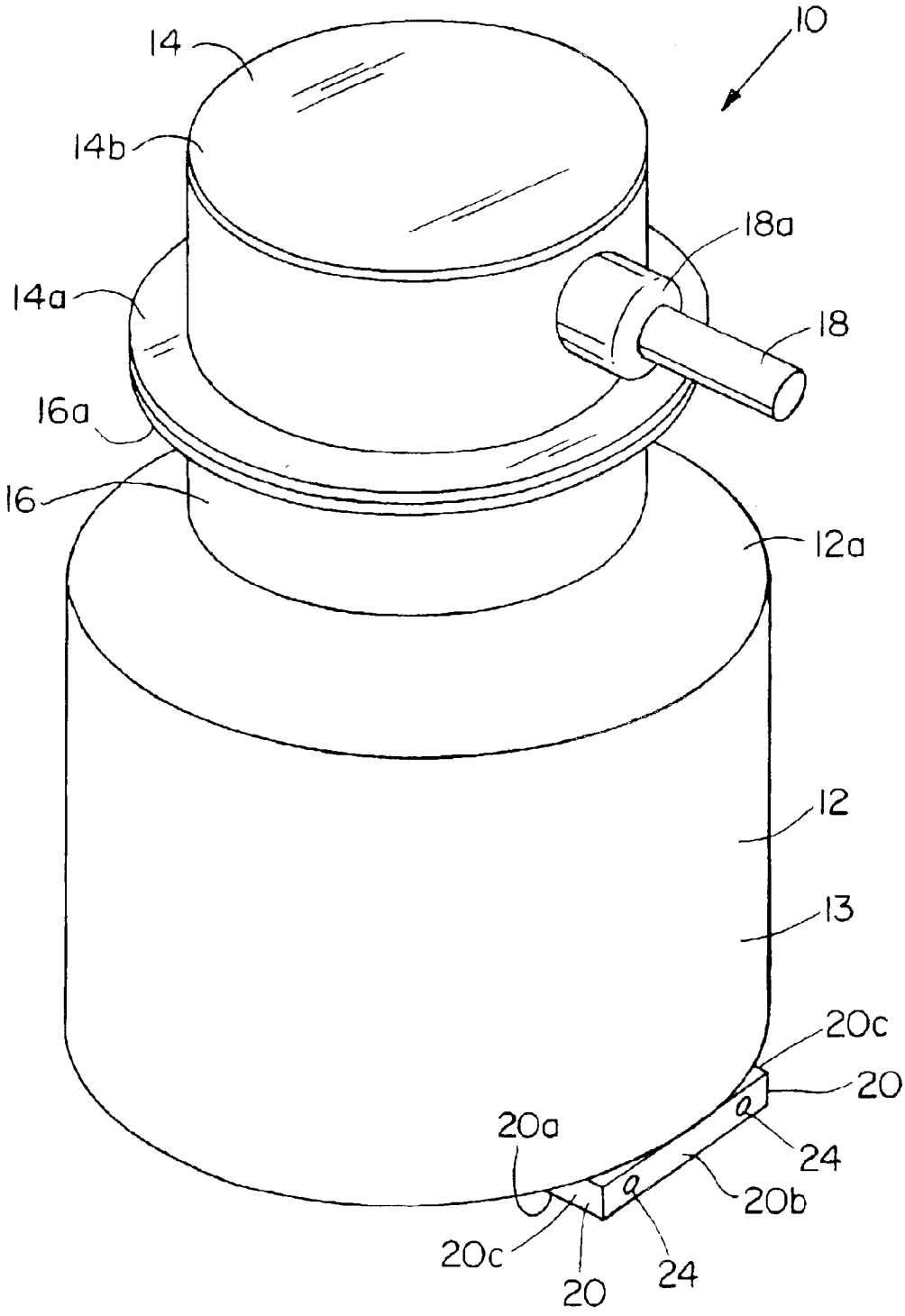
FIG. 1 is a perspective view of the present invention electron beam accelerator device.
Figure 2:
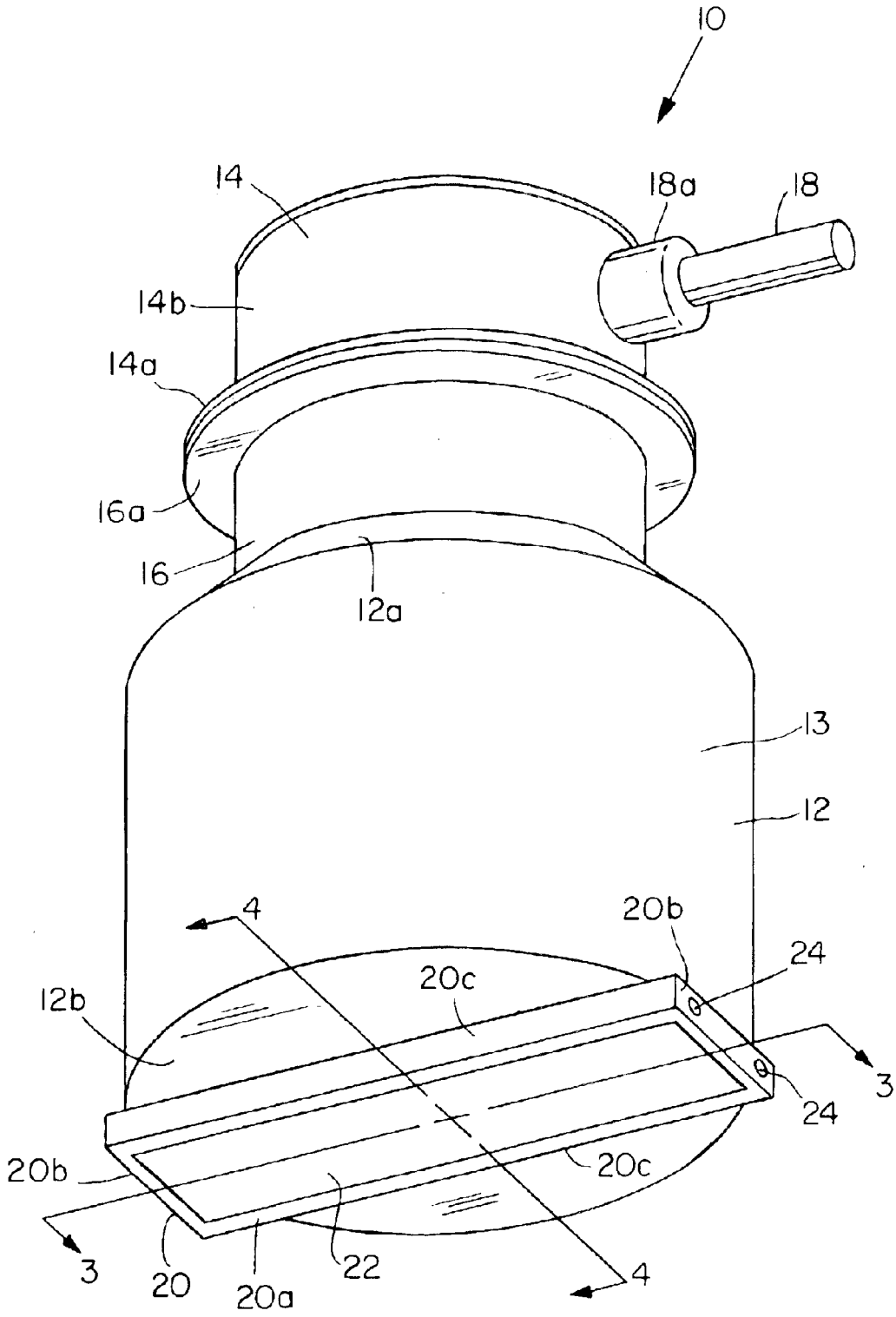
FIG. 2 is a bottom perspective view of the present invention electron beam device.
Figure 3:
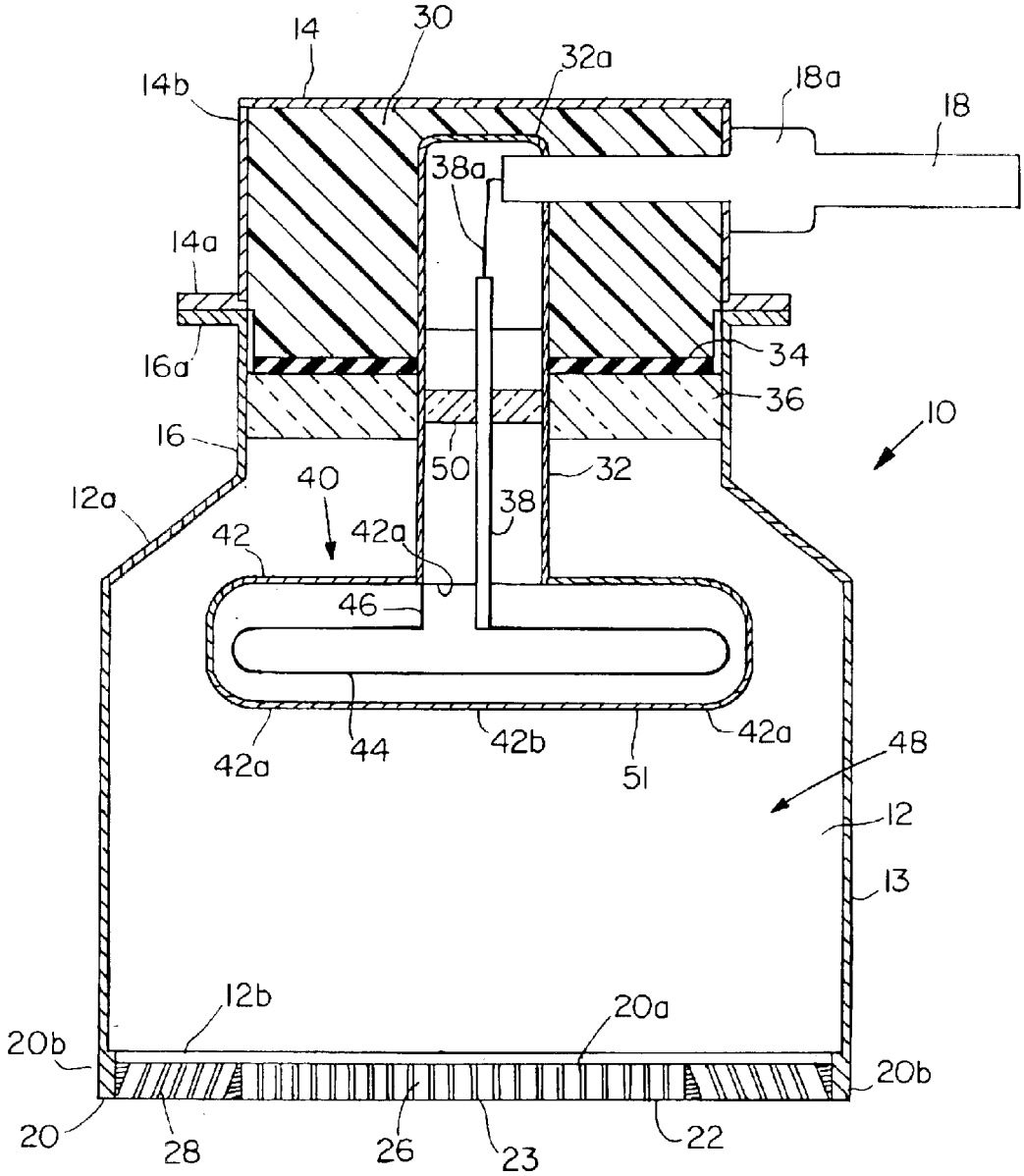
FIG. 3 is a side sectional view of the present invention electron beam device taken along lines 3—3 in FIG. 2.
Figure 4:
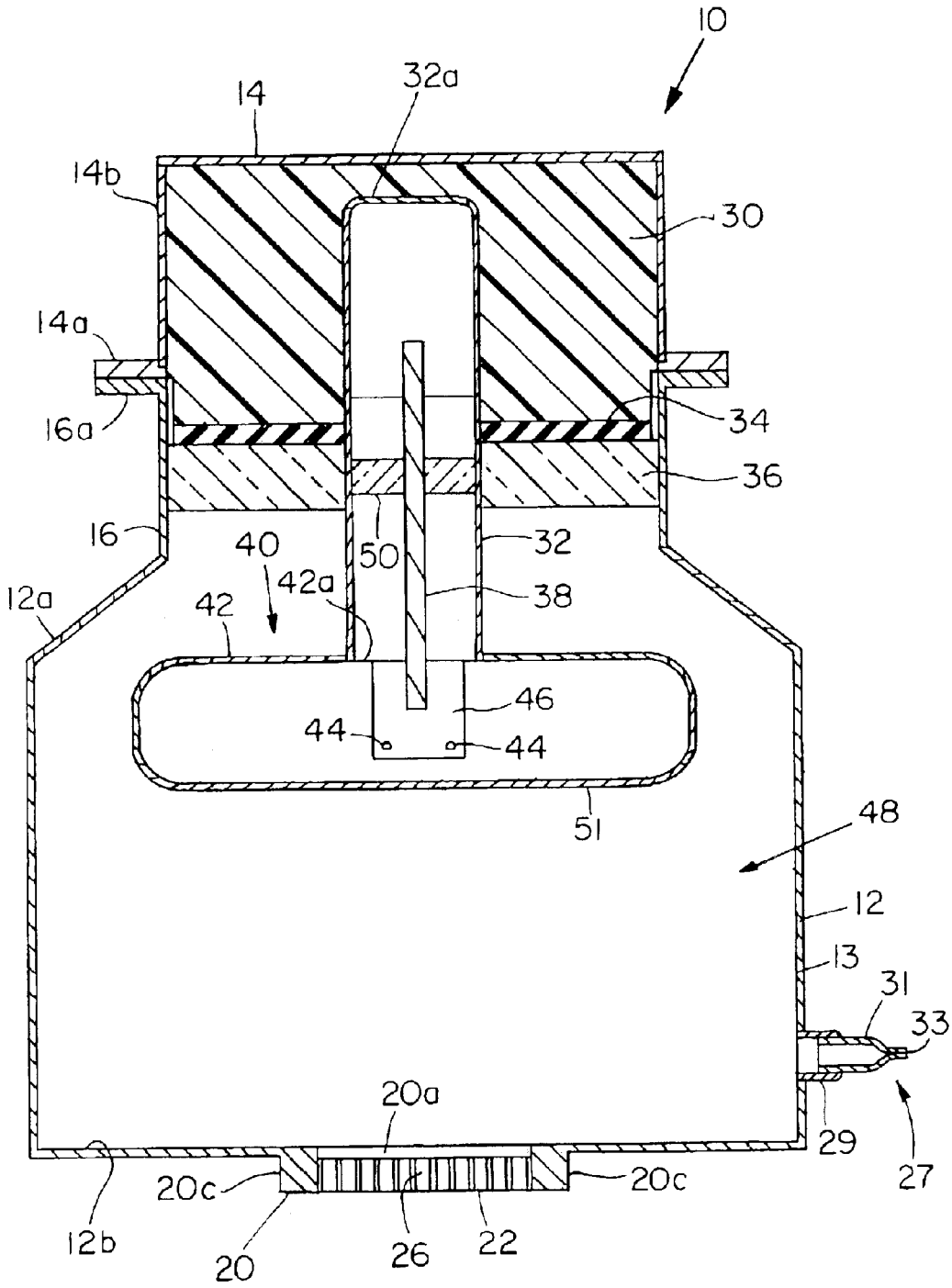
FIG. 4 is a side sectional view of the present invention electron beam device taken along lines 4—4 in FIG. 2.

Referring to FIGS. 1 and 2, support plate 20*a* of exit window 20 extends below the bottom wall 12*b* of vacuum chamber 12 and includes coolant passages 24 for cooling exit window 20 by pumping coolant therethrough. The center portion of ends 20*b* of exit window 20 are preferably flush with the outer surface of opposing sidewalls 13 of vacuum chamber 12. The sides 20*c* of exit window 20 are positioned inward from the sidewalls 13. Support plate 20*a* is preferably made of copper for heat dissipation and machined from the same piece forming bottom 12*b*. Alternatively, the support plate 20*a* and bottom 12*b* can be separate pieces which are welded or brazed together. In addition, bottom 12*b* can be stainless steel. The holes 26/28 (FIG. 3) in support plate 20*a* are about ⅛ inch in diameter and provide about an 80% opening for electrons 60 to pass through exit window 20. Holes 28 in one preferred embodiment are at an angle θ of 23° and begin a distance $W_2$ ¼ to ⅜ inches away from the outer surface of sidewalls 13. This results in an electron beam of about 11.75 inches wide and about 2.5 inches across for a 10 inch diameter vacuum chamber 12. Exit window membrane 22 is preferably titanium foil between about 6 to 12 microns thick with about 8 to 10 microns being the more preferred range. Thicker membranes can be used for higher voltage applications and thinner membranes for lower voltage. Alternatively, membrane 22 can be made of other suitable metallic foils such as magnesium, aluminum, beryllium or suitable non-metallic low density materials such as ceramics.

High voltage power supply 15 (FIG. 5) is typically about 100 kV but can be higher or lower depending upon the application and/or the thickness of membrane 22. Filament power supply 25 preferably provides about 15 volts. Filament housing 42 is preferably formed of stainless steel and disc shaped but alternatively can be elongate in shape. Filaments 44 are preferably made of tungsten or doped tungsten and electrically connected together in parallel.

An inlet 27 (FIG. 4) is provided in vacuum chamber 12 for evacuating vacuum chamber 12. Inlet 27 includes a stainless steel outer pipe 29 which is welded to the side wall 13 of vacuum chamber 12 and a sealable copper tube 31 which is brazed to pipe 29. Once vacuum chamber 12 is evacuated, pipe 31 is cold welded under pressure to form a seal 33 for hermetically sealing vacuum chamber 12 with a permanent vacuum therein.

Figure 10:
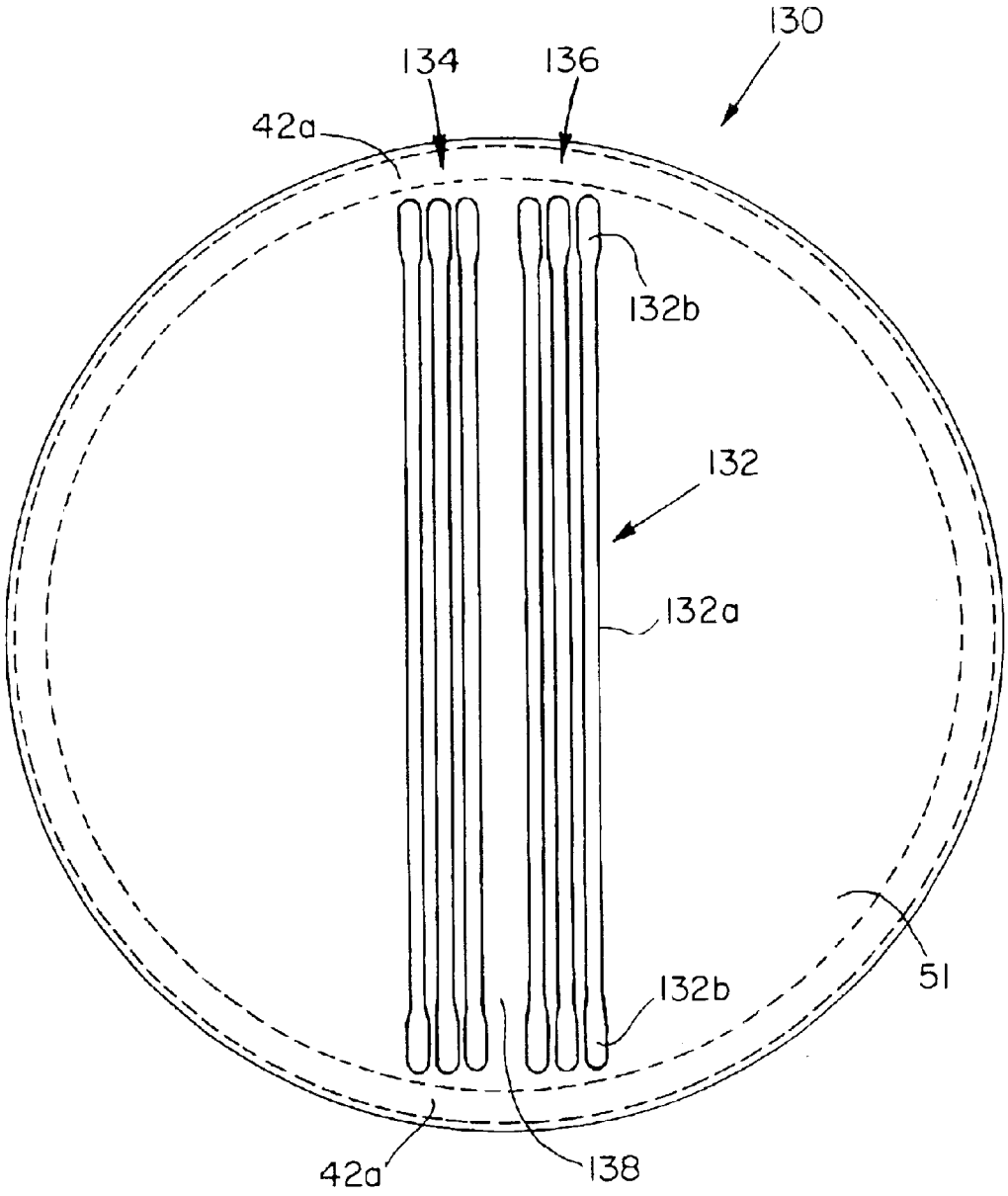
FIG. 10 is a bottom view of another preferred filament housing.

FIG. 10 depicts another preferred filament housing 130 for emitting greater numbers of electrons 60 near the ends 42*a*. The bottom 51 of filament housing 130 includes a series of three elongate slots 132 below each filament 44 which extend between ends 42*a*. FIG. 10 depicts the elongate slots 132 being arranged in two groups 134 and 136 separated by a region 138. Each slot 132 includes a narrower middle portion 132*a* and wider end portions 132*b*. The long length and small number of slots 132 cause the high voltage field penetrating into the filament housing 130 to be more uniform than the penetration fields caused by the plurality of openings 52 in filament housing 42 (FIG. 6) so that the electrons 60 travel in a more uniform manner out the filament housing 130. As a result, greater numbers of electrons 60 from filament housing 130 are able to travel along paths corresponding to the holes 26/28 (FIG. 3) in support plate 20*a* for passage therethrough and the number of electrons 60 absorbed by the sides of holes 26/28 is reduced. Consequently, the resulting electron beam has a greater concentration of electrons 60 (about 10% to 20%) than with filament housing 42. In addition, the support plate 20*a* absorbs less energy and, therefore, operates at a cooler temperature. The use of three slots 132 per filament 44 instead of one slot 132 widens the thickness of the electron beam and increases the electron extraction efficiency. Although slots 132 have been depicted to have middle portions 132*a* with parallel sides, alternatively, middle portions 132*a* can angle gradually outwardly and blend with end portions 132*b*. Also, although a specific pattern of slots 132 have been shown, slots 132 can be arranged in other suitable patterns. An alternate method of generating greater concentrations of electrons 60 near the ends 42*a* of an electron gun 40 (FIG. 3) employs multiple filaments 44 (more than two) positioned within housing 42 with the filaments 44 near the ends 42*a* being positioned closer together than in the middle 42*b*.

Figure 11:
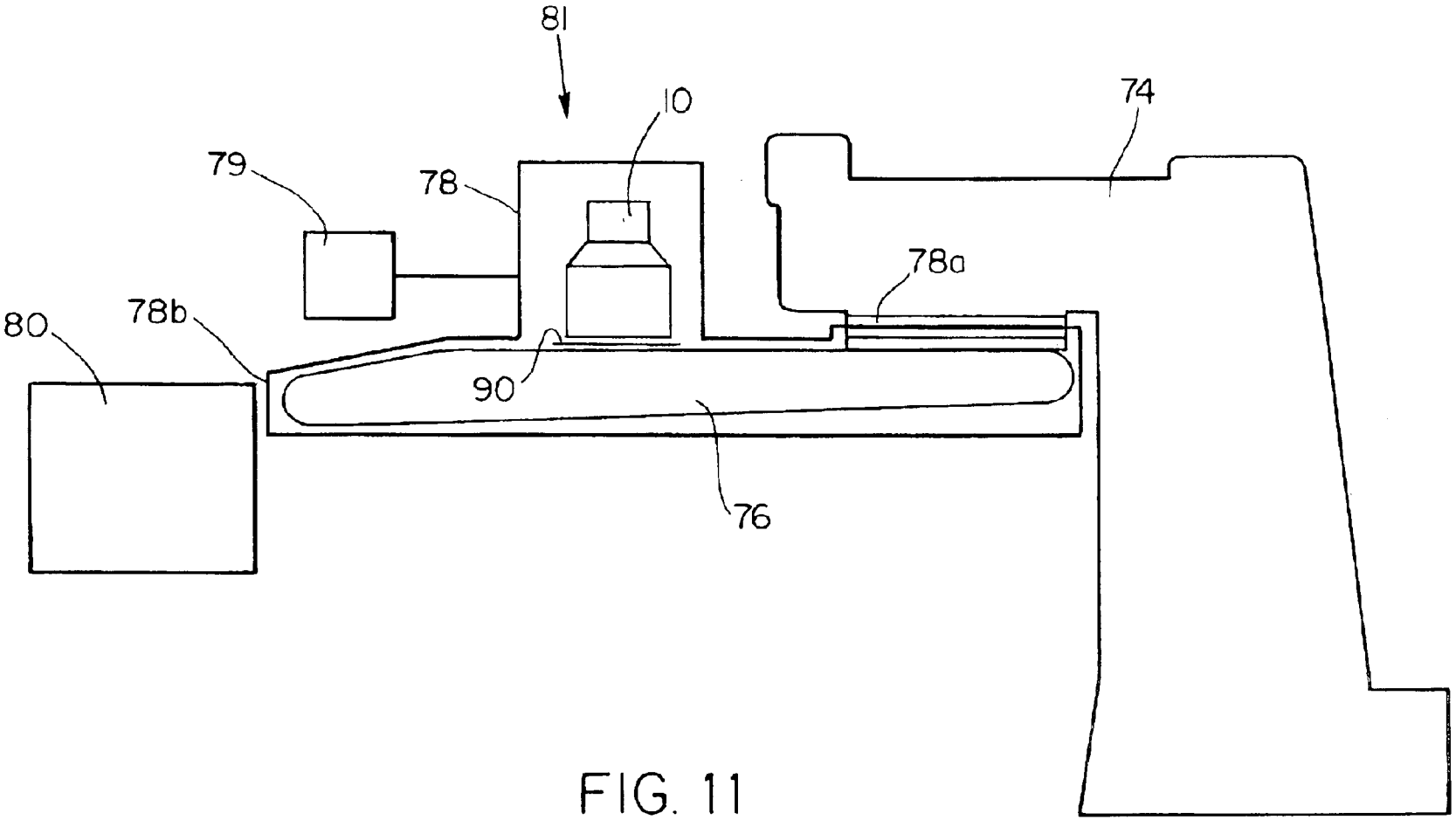
FIG. 11 is a side schematic view of an electron beam system for a sheet-fed printing machine.

Referring to FIG. 11, electron beam device 10 can be employed in an electron beam system 81 for curing ink on printed sheets of paper 90 exiting a sheet-fed printing machine 74. This is accomplished by providing electron beam system 81 having a conveyor system 76, preferably with a stainless steel belt for conveying the printed sheets of paper 90 from sheet-fed printing machine 74, and an electron beam device 10 positioned above the conveyor system 76. A lead enclosure encloses both the electron beam device 10 and the conveyor system 76. The printed sheets 90 from sheet-fed printing machine 74 travel under electron beam device 10 along conveyor system 76 between about 500–800 ft/min. An electron beam 68 generated by electron beam device 10 cures the printed ink on the sheets of paper 90. Enclosure 78 prevents x-rays as well as electrons 60 from escaping enclosure 78. Nitrogen gas is introduced within enclosure 78 from a nitrogen gas source 79 so that the ink printed on the sheets 90 is cured in an oxygen free environment, thereby enabling a more complete cure. The entrance 78*a* and exit 78*b* to enclosure 78 have minimal openings to the environment to minimize the amount of nitrogen gas escaping, thereby reducing the amount of nitrogen gas required and providing x-ray shielding. The cured sheets 90 are then collected in stacker 80. This application is typically useful for existing sheet-fed printing machinery.

Although only one electron beam device 10 has been shown in FIG. 11, multiple electron beam devices 10 can be mounted adjacent to each other as in FIGS. 7A and 7B within enclosure 78 for curing wide sheets 90. In addition, although nitrogen gas is preferably introduced into enclosure 78, other suitable inert gases can be employed. In addition, electron beam devices 10 can be mounted in series to increase the curing speed.

Figure 12:
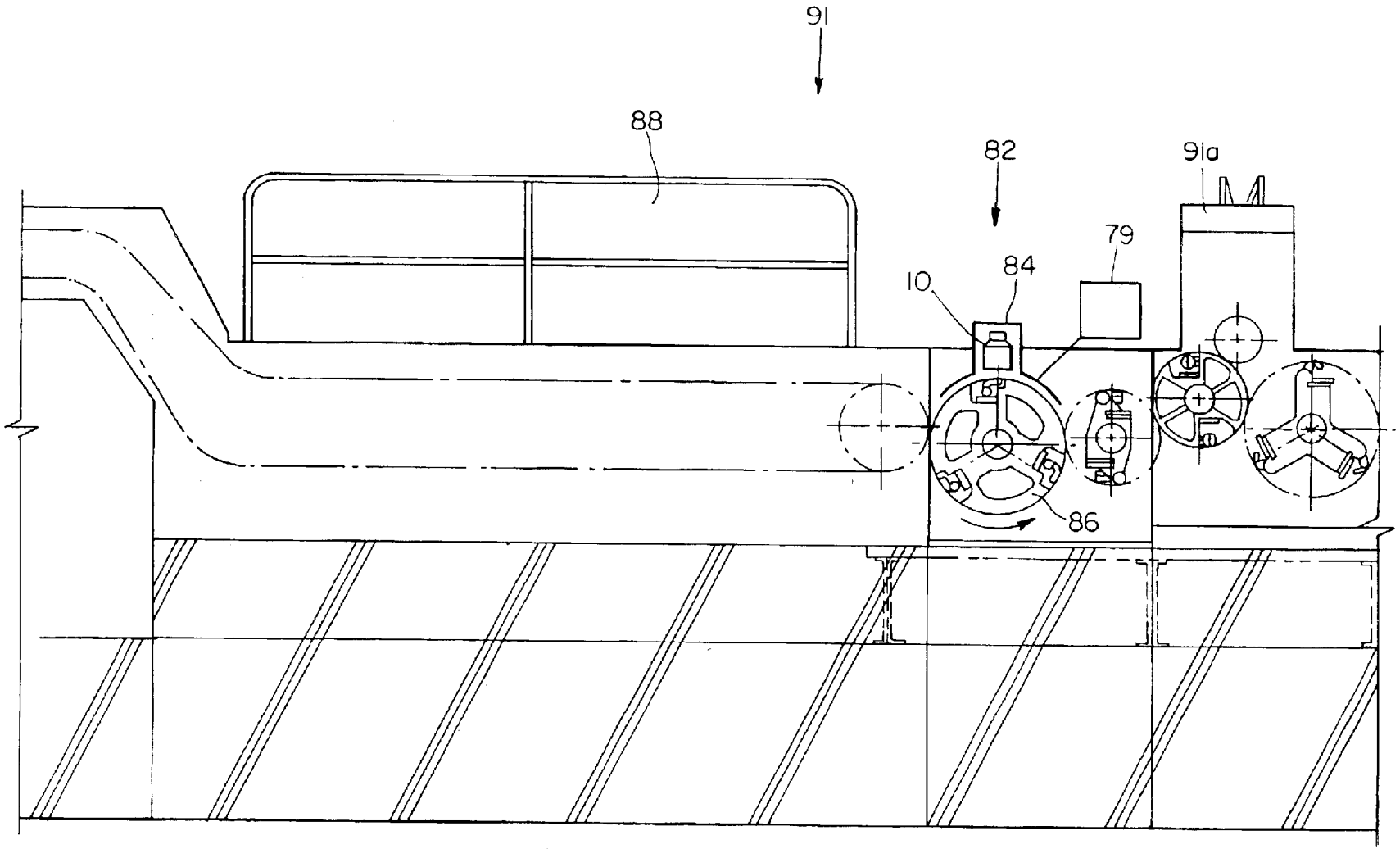
FIG. 12 is a side schematic view of another preferred electron beam system for a sheet-fed printing machine.
Figure 13:
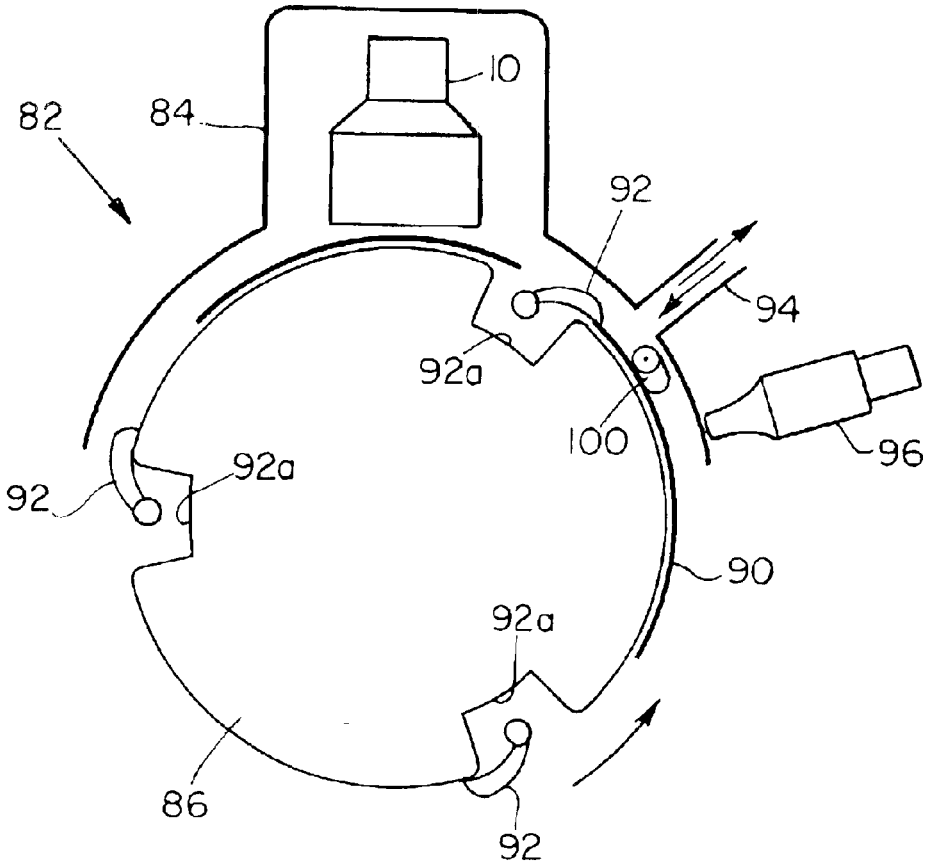
FIG. 13 is an enlarged side view of the electron beam system of FIG. 12.
Figure 14:
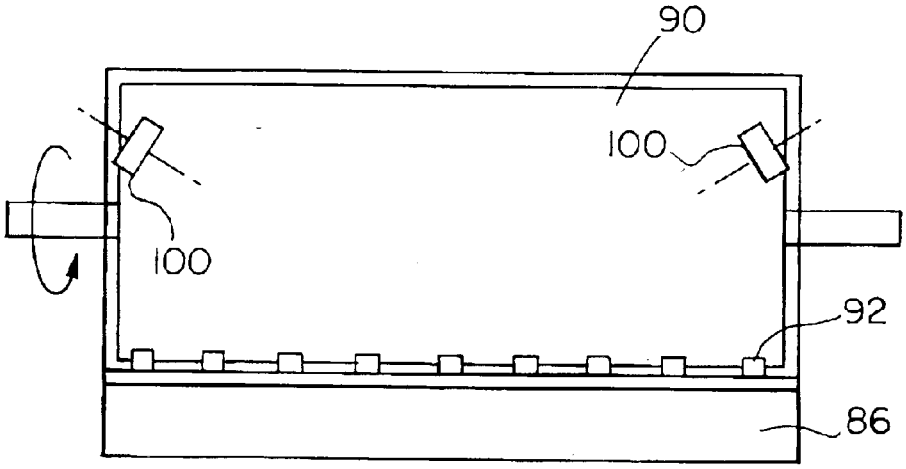
FIG. 14 is a front view of the rotary transfer cylinder depicted in FIG. 13.

Referring to FIGS. 12–14, electron beam system 82 is another preferred system for curing inks applied with a sheet-fed printing machine 91 and is typically employed for new installations. Electron beam system 82 is placed between the printer 91*a* and conveyor system 88 of sheet-fed printing machine 91 and includes a rotary transfer cylinder 86, an electron beam device 10 and an enclosure 84. Nitrogen gas is provided to enclosure 84 by nitrogen gas source 79. The transfer cylinder 86 of electron beam system 82 receives printed sheets of paper 90 from printer 91*a*. The leading edge of each sheet 90 is held by grippers 92 which are positioned within openings 92*a* within transfer cylinder 86 (FIGS. 13 and 14). A pair of rollers 100 angled or skewed inwardly in the direction of rotation contact and apply pressure on the unprinted edges of each sheet 90. This prevents sheets 90 from bubbling in the middle and holds sheets 90 tight against the transfer cylinder 86. Sheets 90 are further held against the transfer cylinder 86 by an ultrasonic horn 96. The ultrasonic horn 96 vibrates the nitrogen gas within enclosure 84 against sheets 90 which pushes sheets 90 against the transfer cylinder 86 without the horn 96 actually touching and damaging the uncured ink on sheets 90. As a result, enclosure 84 can be positioned extremely close to the transfer cylinder 86 about 1/16 to 1/8 inches away such that air surrounding enclosure 84 is not readily introduced into enclosure 84 by the rotation of transfer cylinder 86. As the sheets 90 are rotated on transfer cylinder 86, the sheets 90 pass under electron beam device 10 to cure the ink thereon. The cured sheets 90 are then conveyed away by conveyor system 88.

As with electron beam system 81, electron beam system 82 can include multiple electron beam devices 10. A recirculating blower 94 can also be employed instead of the ultrasonic horn 96 or rollers 100 to blow recirculated nitrogen gas against sheets 90 to press sheets 90 against transfer cylinder 86. Blower 94 can recirculate the nitrogen gas within enclosure 84 to minimize the amount of nitrogen gas used. In addition, horn 96 or rollers 100 can be employed with transfer cylinder 86 either independently or with blower 94. Also, multiple ultrasonic horns 96 and blowers 94 can be used. Furthermore, sheets 90 can be held against transfer cylinder 86 with jets of nitrogen gas from nitrogen gas source 79. The methods of holding sheets 90 in electron beam system 82 can be employed in electron beam system 81.

Figure 15:
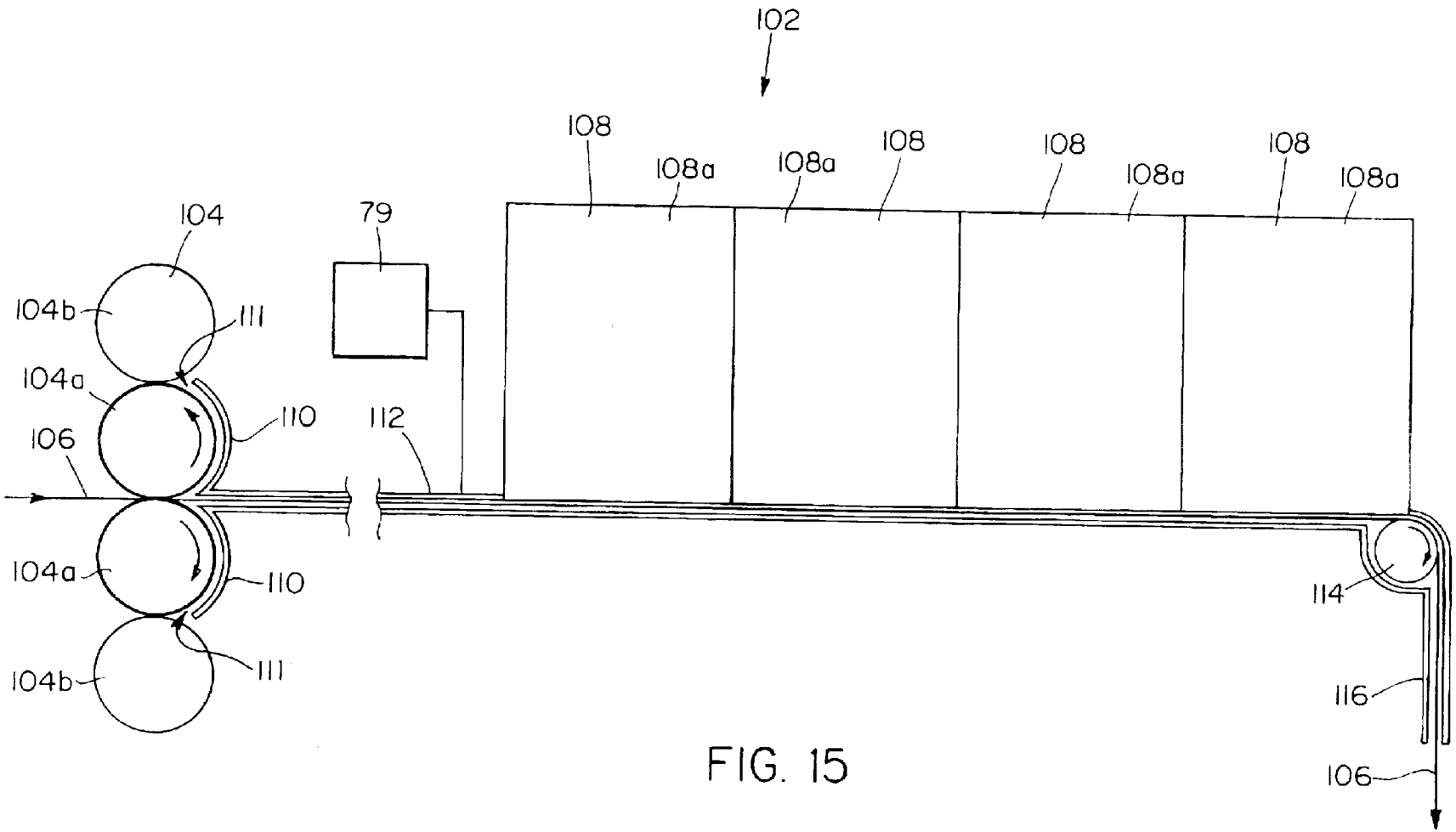
FIG. 15 is a side view of an electron beam system for a continuously moving web.
Figure 16:
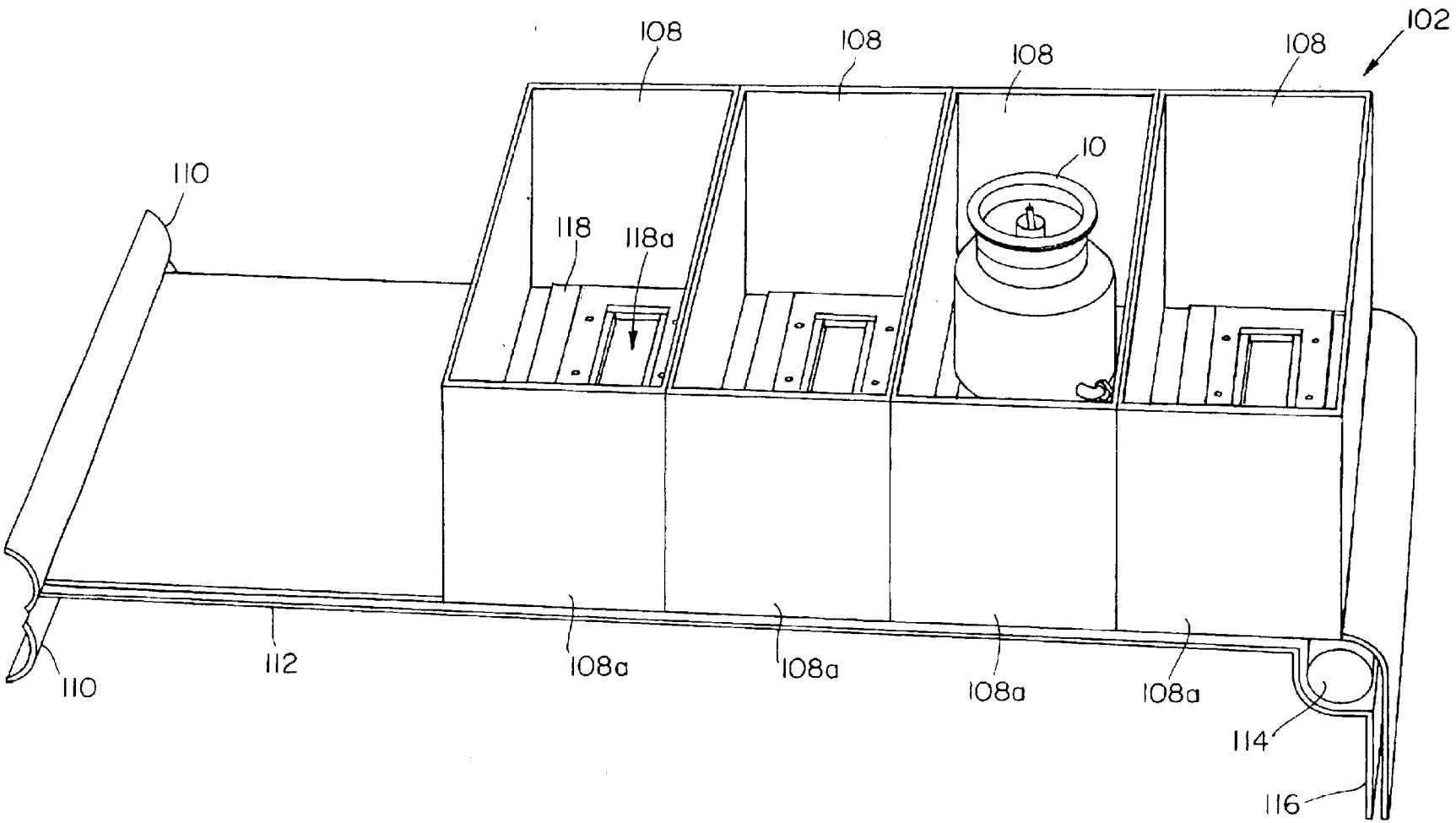
FIG. 16 is a perspective view of the electron beam system of FIG. 15.

Referring to FIGS. 15 and 16, electron beam system 102 is employed in high speed continuous printing of a web 106. Electron beam system 102 is formed from a number of electron beam modules 108 which are joined together in series above web 106. Each module 108 includes three electron beam accelerator devices 10 which are mounted in-line together on a machine base 118 with the exit windows 20 fitting within a cavity 118*a* and being joined end to end such as shown in FIGS. 7A and 7B. By positioning multiple modules 108 in series along the direction of web movement, curing can be conducted at high speed. In order to cure at speeds of 3000 ft/min. such as in high speed continuous web printing, if one device 10 can cure at about 750–800 ft/min., then four electron beam modules 108 should be positioned in series in the direction of web movement to obtain a complete cure. Each electron beam module 108 irradiates the full width of the moving web 106 with a continuous electron beam. Single or doubled sided curing is possible with electron beam system 102.

Modules 108 have a box shaped outer enclosure 108*a* with top covers (not shown) enclosing the top of each individual module 108. The bottom of each module 108 is mounted to an elongate enclosure 112 which encloses a portion of the moving web 106 between coating or printing rollers 104 and roller 114. The sides of enclosure 112 and other structural features have been removed for clarity in FIGS. 15 and 16. The two rollers 104*a* adjacent to web 106 receive ink or coating from outer rollers 104*b* and transfer the ink or coating to web 106. Rollers 104*a* act as pinch rollers on web 106. Nitrogen gas is introduced into enclosure 112 from nitrogen gas source 79. The upstream edge of enclosure 112 has two curved shields 110 which are positioned in close relationship to rollers 104 (about 1/16 inches away) to minimize intrusion by external air. In addition, since the rollers 104 adjacent to web 106 rotate toward the gaps 111 between rollers 104 and shields 110, air does not tend to be drawn into gaps 111. The rollers 104 adjacent to web 106 drive web 106 and squeeze out or block the boundary layer of air on web 106 so that the movement of web 106 into enclosure 112 does not introduce air within enclosure 112 to contaminate the nitrogen gas environment and the air boundary layer is immediately replaced with a nitrogen boundary layer.

The downstream end of enclosure 112 wraps around a roller 114 in close relationship (about 1/4 inches away) at a right angle and includes a shield portion 116 close to web 106 (about 1/8 inches away) on the downstream side of roller 114 such that rotation of roller 114 does not tend to draw air into enclosure 112.

Although three electron beam devices 10 have been described to be within each electron beam module 108, module 108 can have more than or less than three devices 10 depending upon the application at hand. In addition, electron beam system 102 can have more than or less than four modules depending upon the web speed. Furthermore, instead of employing modules 108, all the electron beam devices 10 can be mounted within a single enclosure.

Figure 17:
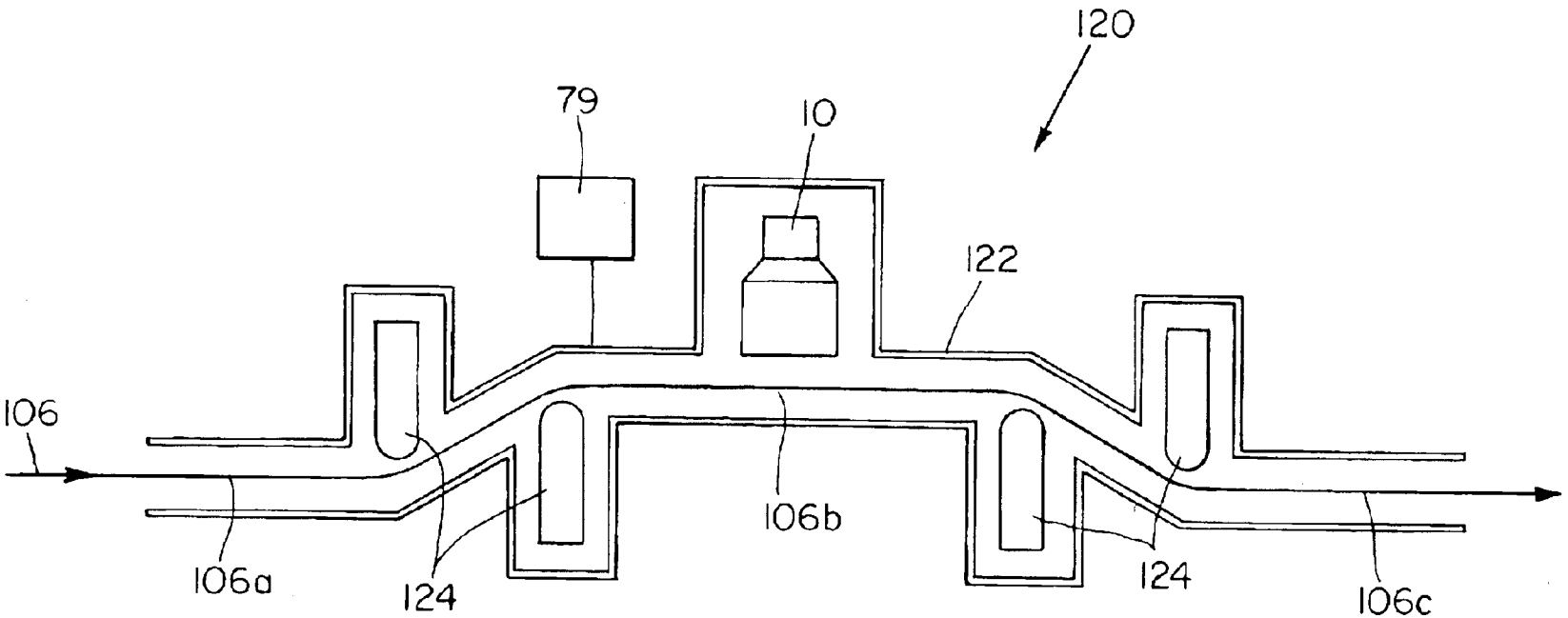
FIG. 17 is a side view of another preferred electron beam system for a continuously moving web.

Referring to FIG. 17, electron beam system 120 is another preferred system for curing moving web 106. Enclosure 122 encloses a portion of web 106 which has sections 106*a*/106*c* entering and exiting enclosure 122 at the same horizontal level or at any horizontal level or other angles. A mid-section 106*b* under electron beam device 10 is raised relative to sections 106*a* and 106*c*. This is accomplished by redirecting web 106 with a series of ultrasonic horns 124. The ultrasonic horns redirect web 106 without damaging the wet ink or coating on the web 106 electron beam device 10. Raising mid-section 106*b* relative to sections 106*a*/106*c* allows enclosure 122 to provide effective shielding from x-rays and electrons 60 by preventing a direct path for the radiation to escape the entrance and exit openings of enclosure 122.

Equivalents

While this invention has been particularly shown and described with references to preferred embodiments thereof, it will be understood by those skilled in the art that various changes in form and details may be made therein without departing from the spirit and scope of the invention as defined by the appended claims.

For example, although electron beam device 10 has been shown and described to be in a downward facing orientation, the electron beam device can be employed in any suitable orientation. In addition to curing inks, coatings, adhesives and sealants, electron beam device 10 is suitable for liquid, gas (such as air), or surface sterilization as well as for sterilizing medical products, food products, hazardous medical wastes and cleanup of hazardous wastes. Other applications include ozone production, fuel atomization, cross linking and chemically bonding or grafting materials together. Furthermore, electron beam systems 81, 82, 102 and 120 have been described for printing applications but can also be employed for coating or adhesive applications on paper as well as on other suitable substrates such as fabrics, plastics, wood or metals.

What is claimed is:

1. A system for irradiating a continuously moving web, the web traveling from a pair of upstream pinch rollers to a downstream roller, the system comprising:

an electron accelerator system for irradiating the web with an electron beam;

an enclosure for substantially enclosing the web between the upstream pinch rollers and the downstream roller, the enclosure having an upstream shield positioned close to the up % pinch rollers and a downstream shield positioned close to the downstream roller; and an inert gas source for providing the enclosure with inert gas, the upstream and downstream shields being positioned sufficiently close to the upstream pinch rollers and downstream roller to prevent substantial inert gas from escaping the enclosure, the pinch roller blocking air from the web before the web enters the enclosure such that substantial intrusion of air into the enclosure is prevented.

2. The system of claim 1 in which the electron accelerator system comprises at least one electron beam device positioned within a module enclosure and forming an electron beam module, the electron beam module being mounted to the web enclosure.

3. The system of claim 2 in which more than one electron beam module is positioned in series along the direction of web movements.

4. A system for irradiating a continuously moving web, the system comprising:

an electron accelerator for irradiating the web with an electron beam;

an enclosure for enclosing the electron accelerator and a portion of the web; and series of ultrasonic members within the enclosure over which the web travels, the ultrasonic members redirecting the web within the enclosure, the closure having an entrance and exit for the web which are out of direct alignment with the electron accelerator to prevent the escape of radiation from the enclosure.

5. A method of ating a continuously moving web, the web traveling from a pair of upstream pinch rollers to a downstream roller, the method comprising:

substantially enclosing the web between the upstream pinch rollers and the downstream roller within an enclosure, the enclosure having an upstream shield positioned close to the upstream pinch rollers and a downstream shield positioned close to the downstream roller;

filling the enclosure with inert gas from an inert gas source, the upstream and downstream shields being positioned sufficiently close to the upstream pinch rollers and the downstream roller to prevent substantial inert gas from escaping the enclosure;

blocking air traveling along the web with the upstream pinch rollers before the web enters the enclosure such that substantial intrusion of air into the enclosure is prevented; and irradiating the web with an electron beam from an electron accelerator system.

6. The method of claim 5 comprising positioning at least one electron beam device within a module enclosure to form an electron beam module, the electron beam module being mounted to the web enclosure.

7. The method of claim 6 further comprising positioning more than one electron beam module in series along the direction of web movement.

8. A method of irradiating a continuously moving web comprising:

providing an electron accelerator for irradiating the web with an electron beam;

enclosing the electron accelerator and a portion of the web within an enclosure; and redirecting the web win the enclosure with a series of ultrasonic members over which the web travels, the enclosure having an entrance and exit for the web which are out of direct alignment with the electron accelerator to prevent the escape of radiation from the enclosure.

9. The system of claim 1 in which the electron accelerator system provides double sided curing.

10. The method of claim 5 further comprising providing double sided curing with the electron accelerator system.

* * * * *

UNITED STATES PATENT AND TRADEMARK OFFICE

CERTIFICATE OF CORRECTION

PATENT NO. : 6,882,095 B2
DATED : April 19, 2005
INVENTOR(S) : Tzvi Avnery

It is certified that error appears in the above-identified patent and that said Letters Patent is hereby corrected as shown below:

Title page,
Item [62], Related U.S. Application Data, delete "Dec. 1" and insert -- Dec. 10 --.

Column 11,
Line 27, delete "up %" and insert -- upstream --.
Line 33, delete "roller" and insert -- rollers --.
Line 44, delete "movements" and insert -- movement --.

Column 12,
Line 1, insert -- a -- before "series".
Line 3, delete "closure" and insert -- enclosure --.
Line 7, delete "ating" and insert -- irradiating --.
Line 40, delete "win" and insert -- within --.

Signed and Sealed this

Twenty-first Day of March, 2006

JON W. DUDAS
*Director of the United States Patent and Trademark Office*